US005772384A

United States Patent [19]

Richards

[11] Patent Number: 5,772,384

[45] Date of Patent: Jun. 30, 1998

[54] SIDE-LOADING REFUSE VEHICLE

[76] Inventor: Idwall Charles Richards, 48 Terranora Road, Banora Point, New South Wales, 2486, Australia

[21] Appl. No.: 284,675

[22] PCT Filed: Feb. 10, 1993

[86] PCT No.: PCT/AU93/00052

§ 371 Date: Aug. 9, 1994

§ 102(e) Date: Aug. 9, 1994

[87] PCT Pub. No.: WO93/15982

PCT Pub. Date: Aug. 19, 1993

[30] Foreign Application Priority Data

| | | | |
|---|---|---|---|
| Feb. 10, 1992 | [AU] | Australia | PL0792 |
| Feb. 28, 1992 | [AU] | Australia | PL1123 |
| Apr. 3, 1992 | [AU] | Australia | PL1150 |
| Apr. 13, 1992 | [AU] | Australia | PL1884 |
| Aug. 26, 1992 | [AU] | Australia | PL4326 |
| Oct. 22, 1992 | [AU] | Australia | PL5467 |

[51] Int. Cl.[6] ..... B65F 3/20

[52] U.S. Cl. ..... 414/408; 414/525.2; 414/528; 414/679

[58] Field of Search ..... 414/406–409, 414/525.1, 525.2, 525.3, 528, 679

[56] References Cited

U.S. PATENT DOCUMENTS

| | | | |
|---|---|---|---|
| 1,715,364 | 6/1929 | Hirschner | 414/407 X |
| 1,789,050 | 1/1931 | Ochsner | 414/407 X |
| 4,113,125 | 9/1978 | Schiller | 414/406 |
| 4,715,767 | 12/1987 | Edelhoff et al. | 414/408 |
| 4,983,092 | 1/1991 | Richards | 414/408 |
| 5,074,737 | 12/1991 | Pellegrini et al. | 414/408 |
| 5,205,698 | 4/1993 | Mezey | 414/409 X |
| 5,288,196 | 2/1994 | Horning et al. | 414/409 X |
| 5,316,430 | 5/1994 | Horning et al. | 414/409 X |

FOREIGN PATENT DOCUMENTS

| | | | |
|---|---|---|---|
| 314238 | 5/1989 | European Pat. Off. | 414/406 |
| 699322 | 2/1931 | France | 414/407 |
| 3703557 | 8/1988 | Germany | 414/405 |
| 4024568 | 2/1992 | Germany | 414/406 |
| 91249 | 1/1938 | Sweden | 414/407 |
| 2138386 | 10/1984 | United Kingdom | 414/525.2 |

*Primary Examiner*—David A. Bucci

*Attorney, Agent, or Firm*—Fitzpatrick, Cella, Harper & Scinto

[57] ABSTRACT

A side loading refuse vehicle having a cab and storage tank divided into separate upper and lower storage regions suitable for simultaneous collection of recyclable refuse and other household waste using a multi-compartment bin. The vehicle is capable of "one man" operation by use of a retractable loading arm operated by the driver from within the vehicle's cab.

13 Claims, 13 Drawing Sheets

SIDE-LOADING REFUSE VEHICLE

TECHNICAL FIELD OF THE INVENTION

This invention relates to a refuse vehicle and in particular, to a side loading refuse vehicle and more particularly, but not limited to, an automated side loading refuse vehicle for simultaneous collection, but separate storage of garbage and/or recyclable wastes in the one vehicle.

BACKGROUND ART

With the introduction of environmental awareness, the collection of domestic garbage has taken on a new complexion, it being realised that new, convenient and economical approaches to garbage collection and recycling must be introduced. It has been proposed to provide householders with a plurality of waste bins so that each householder can sought waste into various categories.

For example, paper, metal cans and bottles and garbage could conceivably be stored and collected separately and this has been tried, the main problem with this scheme is the high expense insofar as separate collections are required for each category.

The alternative has been to provide local or regional sorting facilities where garbage is hand sorted or expensive automated facilities have been tried with minimal success due to the high expense involved.

In summary therefore, sorting of recyclables from domestic garbage after collection is generally uneconomical.

OUTLINE OF THE INVENTION

The present invention has, as its primary object, to provide a useful alternative to the aforementioned prior art.

In one aspect, the present invention resides in a side loading refuse vehicle including the combination of an elongate refuse storage tank divided into longitudinally extending tank sections, a loading mechanism adjacent a side of the refuse vehicle and a refuse transfer mechanism for delivering refuse or other material emptied into the vehicle by the loading mechanism to the respective tank sections.

The storage tank typically has arcuate side walls and is preferably generally square and medially bulged in shape.

The storage tank of the refuse vehicle typically has a plurality of tank sections and typically has two or three tank sections although more tank sections may be employed.

The tank sections can comprise side-by-side or upper and lower storage regions or combinations of these. The storage regions typically have respective forward and rearward ends and respective entrances adjacent the forward ends through which refuse can enter the regions.

Typically, the tank sections have respective discharge doors with one discharge door being operatively located outside the other discharge door or doors so that the tank sections can be discharged sequentially.

Where an upper storage region is employed, it typically includes a sloping floor which slopes down toward the forward end of the upper storage region so that as the vehicle travels, the sloping floor causes compaction of refuse toward the forward end of the upper storage region.

The transfer mechanism typically includes means for receiving and selectively diverting refuse from a bin, the bin either having two compartments which are side-by-side as the bin is emptied, or having two compartments which are one above the other as the bin is emptied, the transfer mechanism operating so that refuse from the compartments is maintained separate as the refuse is moved to the respective tank sections.

The refuse transfer mechanism typically includes a passive or active mechanism or a combination of passive and active mechanisms selected from the following:

(i) automated bin lid opening devices;

(ii) retractable refuse diversion chutes or bin compartment alignment means;

(iii) bin compartment alignment means which aligns with or abuts against a compartment defining portion of a bin so that refuse from the bin remains separate as it flows or is moved from the bin, through the transfer mechanism and finally into the tank sections;

(iv) a refuse compaction device;

(v) a longitudinally moveable oscillating slide packer; or (vi) a packer which includes an oscillating blade which oscillates about a substantially vertical axis relative to the longitudinal direction of the tank sections.

The transfer mechanism can move material within the tank sections and in one embodiment a conveyor can be used in one or more of the tank sections so that refuse can be conveyed along the tank sections. Typically, the conveyor is an endless belt conveyor or a travelling floor conveyor.

In one preferred form, the transfer mechanism typically comprises a hopper communicating with the tank sections and means for selectively diverting refuse or other material delivered into the hopper by the loading mechanism to the respective tank sections.

In another preferred embodiment, the transfer mechanism comprises a hopper and an oscillating blade in the hopper being adapted to sweep through the hopper to alternately sweep refuse or other material delivered into the hopper by the loading mechanism to one side and then to another side of the hopper as the blade oscillates back and forth within the hopper, the transfer mechanism having a moveable hopper closure means to partially close the hopper behind the blade so as to prevent material intended to be delivered to one side of the hopper being inadvertently delivered to the other side of the hopper as the blade travels through the hopper.

Where the tank sections involve upper and lower storage regions, the transfer mechanism typically comprises respective upper and lower transfer mechanisms for selectively diverting refuse or other material through the entrances to the respective upper and lower storage regions.

In another embodiment, the transfer mechanism typically includes a refuse separating means adjacent the loading mechanism and adapted to be located in close proximity to a bin inverted over the separator means by the loading mechanism for separating refuse delivered into the transfer mechanism so the separated refuse is moved to the respective tank sections.

In one typical use, the present invention involves the alignment of compartments in a bin in predetermined geometry with the transfer mechanism. To this end, the vehicle is typically equipped with a bin alignment means including a bin lead-in guide to take into account relative position of a bin on the loading mechanism, the lead-in guide being disposed to move the bin on the loading mechanism as it is emptied so that it is emptied according to the predetermined geometry relative to the transfer mechanism.

BRIEF DESCRIPTION OF THE DRAWINGS

In order that the present invention can be more readily understood and be put into practical effect, reference will now be made to the accompanying drawings and wherein.

METHOD OF PERFORMANCE

Figure 2:
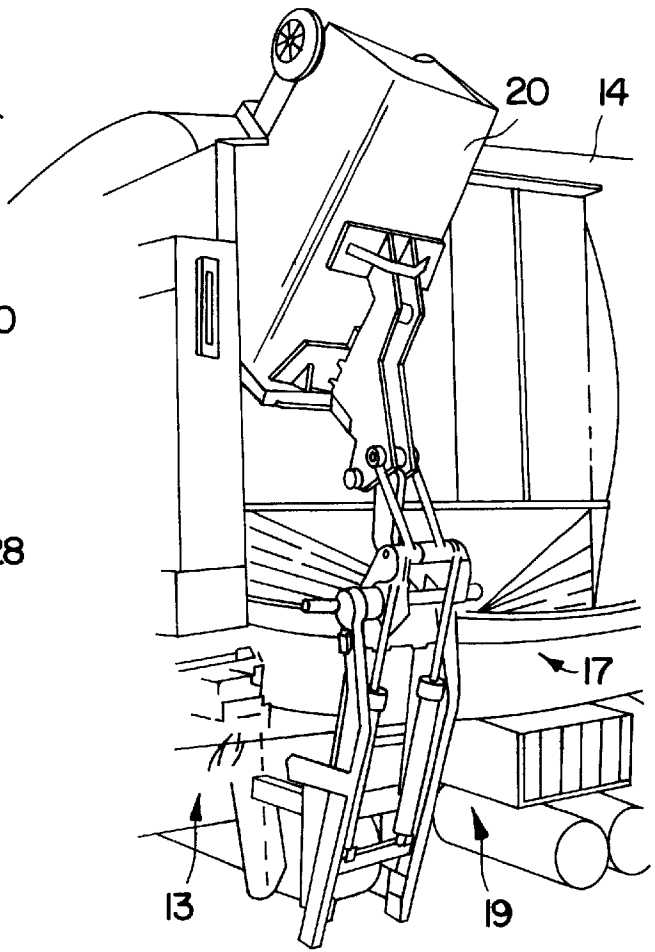
FIG. 2 is cut-away perspective view of the vehicle of FIG. 1 illustrating a further stage in the emptying process.
Figure 1:
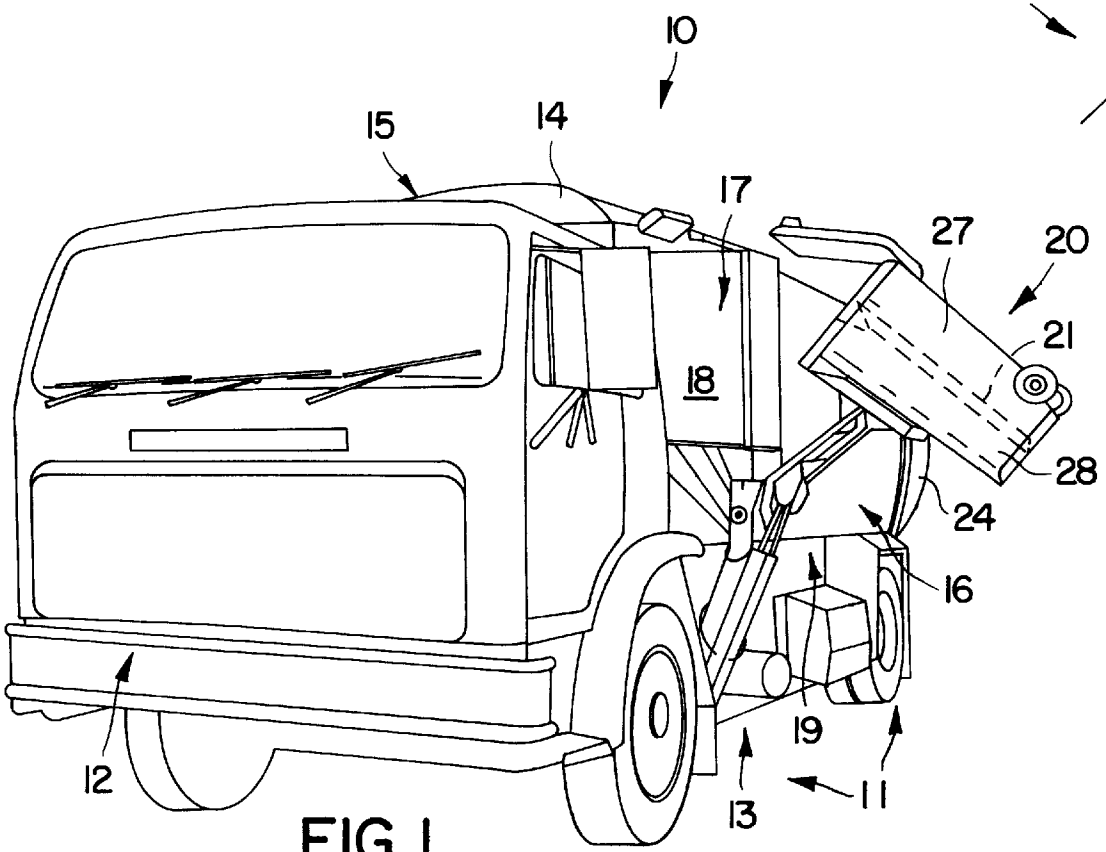
FIG. 1 is a pictorial view illustrating one embodiment of a refuse vehicle according to the present invention showing a bin having compartments one above the other being emptied.
Figure 3:
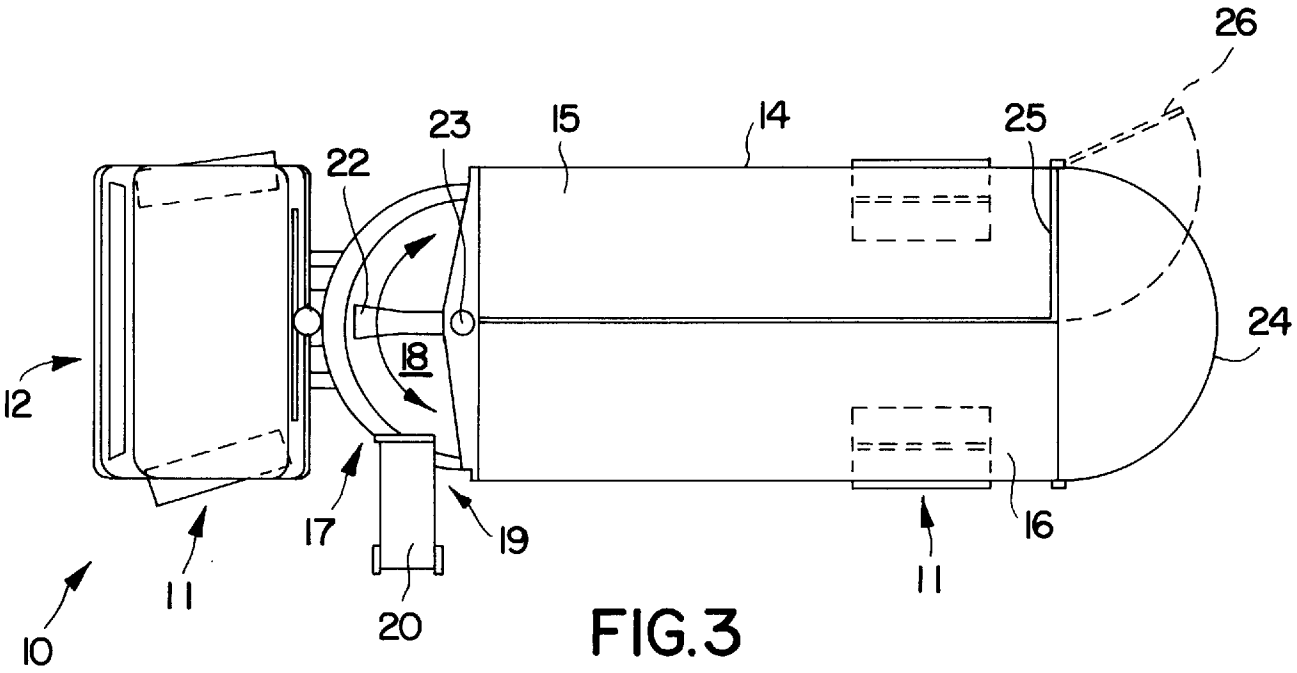
FIG. 3 is a schematic section view illustrating the interior of the refuse vehicle according to FIG. 1.

Referring to the drawings and initially to FIGS. 1, 2 and 3, there is illustrated a side loading refuse vehicle 10 having a wheel assembly 11 supporting a cab 12 and a chassis 13, a storage tank 14 having two tank sections 15 and 16 is mounted on the chassis 13. A hopper 17 having a loading aperture 18 is located behind the cab 12, the hopper is adapted to receive refuse from a loading mechanism 19 adjacent the hopper so that the contents of a multi-compartment bin 20, which in this case includes a central divider partition 21 shown in phantom in FIG. 1, can be partially inverted over the hopper 17 so that the contents of the bin 20 are diverted into the respective tank sections 15 and 16 by the refuse transfer mechanism which can be seen in FIG. 3 is an oscillating blade 22. The blade 22 oscillates about a vertical axis 23 to alternately sweep and compact refuse delivered into the hopper 17 into the respective tank sections 15 and 16.

In the embodiment of FIG. 3, the tank section 16 is generally L-shaped having a "bubble" door 24, the tank section 15 includes a door 25 shown in its open position in phantom at 26. In this embodiment, refuse would initially be discharged from the tank section 16 by opening the bubble door 24 and tipping the tank 14. Once all the refuse contained in tank section 16 had been discharged, the tank 14 would be lowered and the vehicle 10 could be driven to another site where the bubble door 24 and the door 25 would be opened together and the tank 14 tipped again to discharge the contents of the tank section 15. As an alternative to tipping, a travelling floor can be used for discharge purposes.

In the illustrated embodiment, co-mingled recyclables would be stored in the tank section 15 and other garbage would be stored in the tank section 16.

The embodiment of FIGS. 1 to 3 involves a bin having a compartment 27 above a compartment 28 as the bin is being emptied, the position of the blade 22 and the relative positions of compartments 27 and 28 of the bin 20 are set according to a predetermined geometry in order to maintain separation of the refuse from the compartments. Thus, the spatial relationship and geometry is such that a major proportion of the contents of compartment 27 is deposited on the far side of the blade 22 while the contents of the compartment 28 and a major proportion thereof would be deposited on the near side of the blade 22.

Although an open fall of material from the compartments works to some degree, the inclusion of small diversion plates or ramps or other elements in the transfer mechanism is also envisaged to improve the geometry and this will be discussed below.

While the embodiments illustrated so far utilise two tank sections and a refuse transfer mechanism in the form of a compaction device, the refuse transfer mechanism can include a secondary or auxiliary transfer mechanism operating in conjunction with the compaction device to ensure a more reliable separation of the contents of the compartments 27 and 28 of the bin 20 as the contents of the bin flows into the hopper. Examples will be illustrated below.

Figure 5:
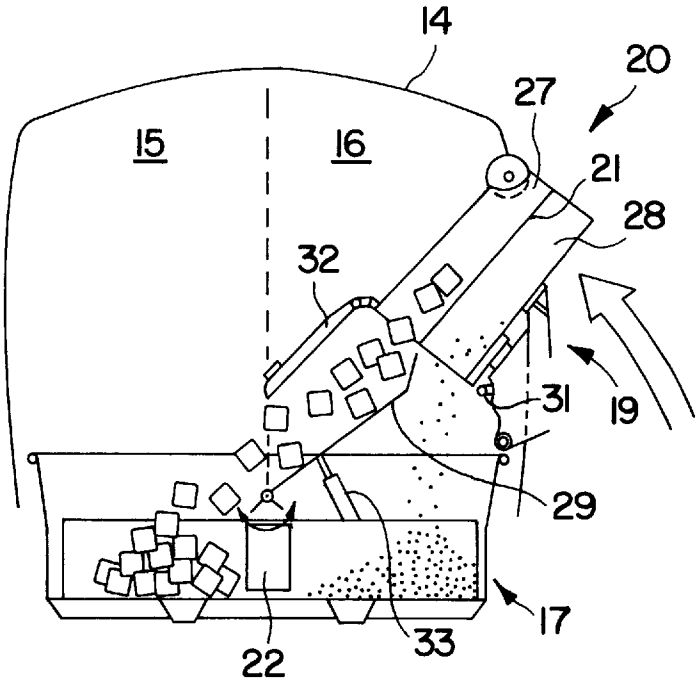
FIGS. 4 and 5 are schematic sectional views illustrating an embodiment of a transfer mechanism suitable for use in a vehicle according to FIGS. 1 to 3.
Figure 4:
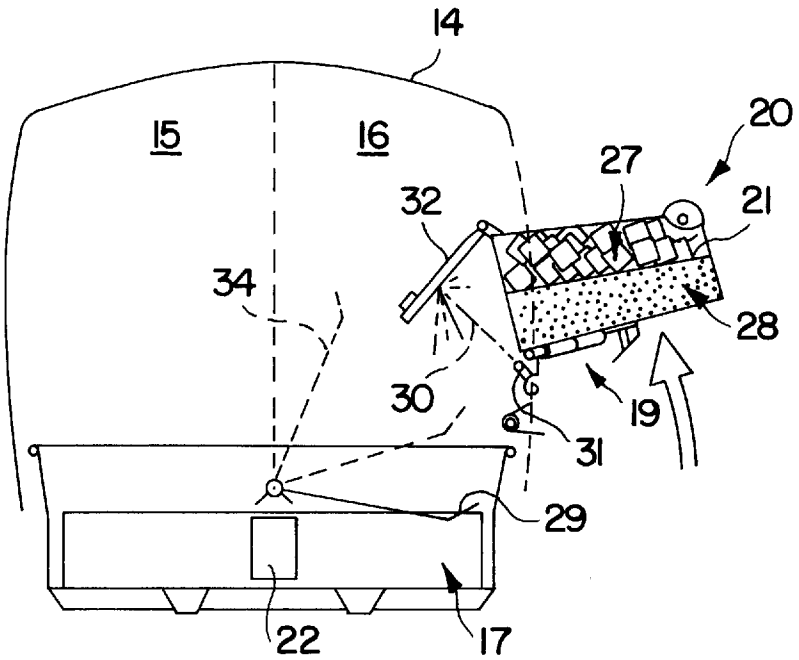

FIGS. 4 and 5 illustrate a further embodiment employing an auxiliary refuse transfer mechanism which in this case is a pivoting ramp 29 which moves to a position illustrated in FIG. 5 being aligned with the partition 21 of the bin 20. Ramp 29 is timed to move to its aligned position with the partition 21 just after a jet of water shown at 30 fired from nozzle 31 on the loading mechanism 19 opens the lid 32 of the bin 20 prior to the contents of the bin 20 being discharged. This will be slightly delayed due to the inertia of the bin being raised through its arc of movement to the final stop position illustrated in FIG. 5. In other words, the combined effect of the movement of the bin through its arc followed by the jet of water discharged from the nozzle 31 followed by raising of the ramp into the aligned position illustrated in FIG. 5 will ensure that minimal recyclables from compartment 27 end up in the wrong tank section. As an alternative to the jet of water, other mechanically equivalent contrivances can be employed including air jets or directly acting mechanical lid openers.

As can be seen in FIGS. 4 and 5, a hydraulic, pneumatic, electric or other cylinder assembly 33 is employed to move the ramp 29 into position.

In another embodiment, the ramp 29 can be arranged to be moved into position illustrated in phantom at 34 so that all of the contents of the bin 20 will be transfered to tank section 16. This situation may arise in communities where some householders choose not to recycle. In these circumstances, each bin 20 would be provided with some form of indicator or signal operable by the householder to indicate whether or not the bin was a multi-compartment bin or a single, compartment bin or whether it was full of garbage without any recyclables. The driver of the vehicle on seeing the signal would operate controls to retract the ramp 29 to the position illustrated at 34 for those bins which do not contain recyclable material and the full contents of the bin would travel through into tank section 16 which, as mentioned above, in this embodiment is devoted to non-recyclables. Where a multi compartment bin having correctly filled compartments is to be emptied, ramp 29 would be operated as shown in FIG. 5.

Figure 6:
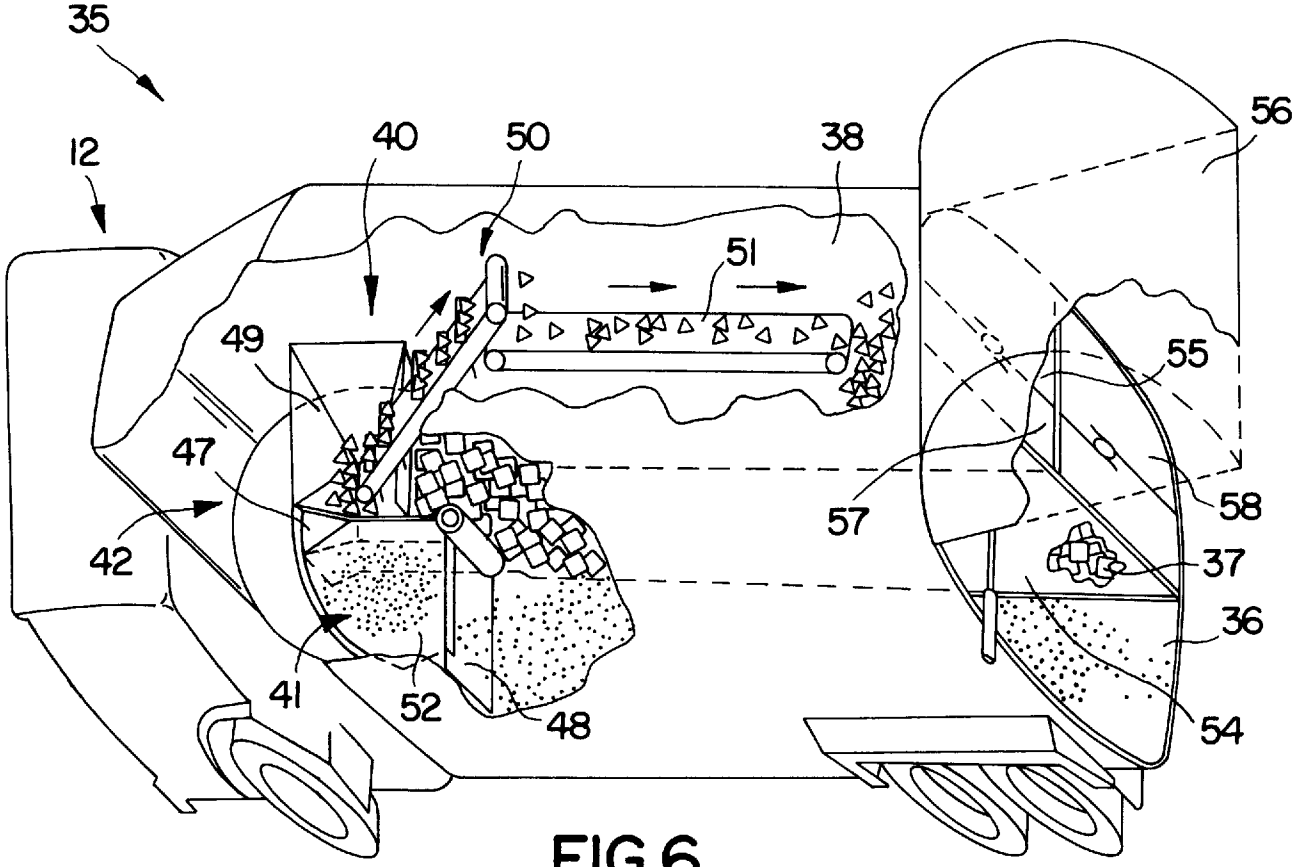
FIG. 6 is a schematic cut-away pictorial view illustrating one preferred form of refuse vehicle according to the present invention having three tank sections.

The embodiment of FIGS. 1 to 5 illustrates a two tank section vehicle. An alternative to this is a vehicle for use with a triple compartment bin. This embodiment is illustrated in FIG. 6. As can be seen, there is illustrated a vehicle 35 where the storage tank in this embodiment has three tank sections comprising a side tank section 36, a lower tank section 37 and an upper tank section 38 for separate storage of refuse delivered into a hopper 40. The hopper 40 includes a loading aperture 41 which in this case is adjacent a side of the vehicle so that the refuse vehicle 35 operates as a side loading refuse vehicle.

A loading mechanism (not shown) as in the previous embodiment is used to empty the contents of a triple-compartment bin 43 (see FIG. 7) into the hopper 40 through the aperture 41 and a refuse transfer mechanism 42 selectively diverts refuse delivered from the triple-compartment bin into the respective tank sections 36, 37 and 38. In the illustrated embodiment, three types of refuse are shown and these are illustrated by the dots, squares and triangular shapes in order to show how the separation occurs.

As can be seen from FIGS. 6 to 10, a refuse bin 43 for use with the vehicle 35 includes three compartments 44, 45 and 46 which contain separately the different kinds of refuse which typically have been separated by a householder.

Thus, the respective types of refuse when delivered into the hopper 40 travel through the refuse transfer mechanism 42 into the respective tank sections.

As can be seen and also in FIG. 6, an oscillating blade 47 sweeps through a semi-circular sub-hopper 48 which is located below a sub-hopper 49 through which an elevator 50 travels to raise refuse in the sub-hopper 49 up onto an endless belt 51 which conveys refuse to the rear of the tank section 38. This brings about a degree of even distribution and compaction in the tank section 38.

In the illustrated embodiment, the oscillating blade 47 has an upper spill plate 52 which overlays a quadrant of the lower sub-hopper 48 and progressively opens and closes the adjacent quadrants of the sub-hopper 48. Refuse initially delivered onto the plate 52 is above the sub-hopper 48 (see FIG. 9) until the blade 47 moves through its stroke in the direction of tank section 37 where the plate begins to move to the other quadrant and the refuse spills into the sub-hopper 48. The operation of this section of the transfer mechanism will be described in more detail below.

In the illustrated embodiment, the storage tank 36 includes an arcuate side walls 53 defining a generally square but medially bulged shape in section and the interior of the tank 36 is divided by a vertical partition 54 and a horizontal partition 55 defining the respective tank sections 36, 37 and 38. The tank section 36 is generally L-shaped by virtue of the extension provided by the bubble door 56 which is shown open in FIG. 6, and in the illustrated embodiment, the tank section 36 can be raised using a hoist in order to discharge refuse through the open door.

Once refuse has been discharged from tank section 36, internal doors 57 and 58 can be opened sequentially to discharge the contents thereof using a similar tipping action.

It will be appreciated from the foregoing therefore that refuse vehicle 35 will take about half refuse in tank section 36 which in most cases would be normal disposable refuse whereas tank sections 37 and 38 can be used to accommodate two different forms of recyclables. For example, paper could well be stored in tank section 38 while co-mingled glass, plastic bottles and cans could well be stored in tank section 37.

It will be noted that in FIG. 6, when compared to FIGS. 7 to 10, part of the sub-hopper 49 has been omitted to expose the blade 47 and the plate 52 for clarity purposes. The operation of the refuse transfer mechanism will become clearer from the following description.

Referring now to FIGS. 7 to 10, there is illustrated in more detail the refuse transfer mechanism 42 including its operation and where appropriate, like numerals have been used to illustrate like features. The only difference is that in FIGS. 7 to 10, moveable chute 59 has been included in the drawings whereas this moveable chute has been omitted in FIG. 6 but it being understood that the moveable chute forms part of the embodiment illustrated in FIG. 6.

Figure 9:
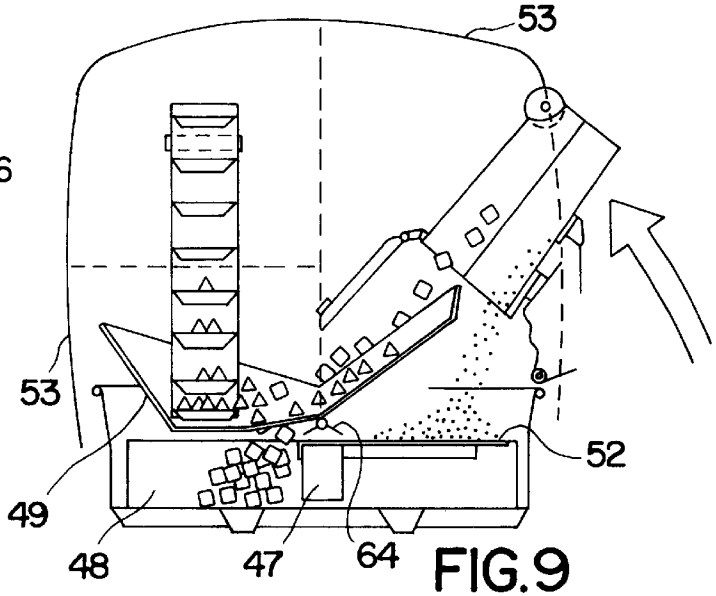
FIGS. 7 to 10 illustrate operation of a preferred transfer mechanism for a vehicle of the type illustrated in FIG. 6.
Figure 10:
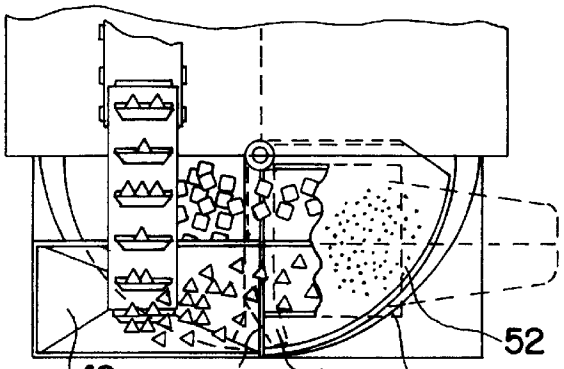
Figure 7:
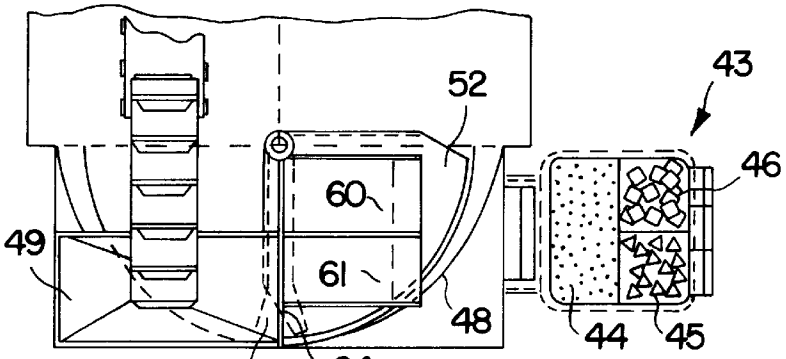
Figure 8:
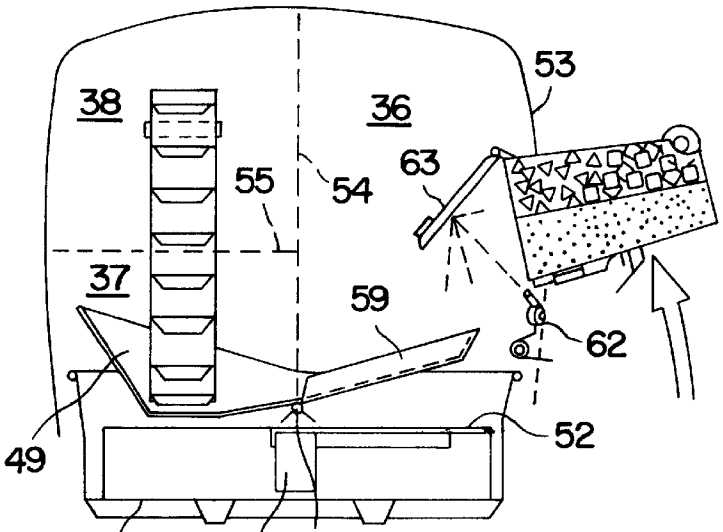

Referring to FIGS. 7 to 10, there is illustrated initially in FIG. 7 a bin 43 engaged on the loading mechanism 19 just prior to an emptying operation being invoked. FIGS. 8, 9 and 10 show the various stages during which the bin 43 is emptied into the hopper 40. The transfer mechanism in this case includes a moveable ramp 59 including first and second ramp sections 60 and 61 which take the contents of compartments 46 and 45 respectively.

As the bin 43 is inverted above the aperture 41 to the position illustrated in FIGS. 9 and 10 (FIG. 10 in phantom), the ramp 59 is moved into the position illustrated in FIG. 9 shortly after a waterjet or airjet via nozzle 62 has been delivered to the lid 63 so that the lid and ramp will not collide.

At this stage, the oscillating paddle 47 is shown half way through its stroke toward tank section 37. The contents of compartment 46 will flow directly into the sub-hopper 48 on the tank section 37 side and be swept by blade 47 into the tank section 37. At the same time, the contents of compartment 44 of the bin 43 will have been deposited onto the quadrant spill plate 52 as illustrated in FIG. 9 and as the blade 47 sweeps towards tank section 37, the sub-hopper 48 on the tank section 36 side thereof will open and the refuse on top of the plate 52 will be pushed off into the sub-hopper 48 on the rearward side of the blade 47 by central fixed scraper 64.

Thus, during the return stroke of the blade 47, lost motion will be experienced between the blade 47 and plate 52 for 90° of the blades travel and the sub-hopper on the tank section 37 side will remain closed. Refuse from compartment 44 which fell off the plate 52 will be transfered into tank section 36 as the blade 47 sweeps towards that tank section. As this happens, refuse will spill into the tank section 37 side of the sub-hopper 48.

The contents of compartment 45 will travel down the ramp section 61 into the sub-hopper 49 and as the sub-hopper 49 fills, operation of the elevator 50 will raise refuse up and deposit same on to the endless conveyor 51 which will move the refuse rearwardly in the tank section 38.

It will be appreciated that a bin can be emptied at any time and depending on the position of the blade 47, as a bin is emptied the contents of the compartments will always reach the right tank section.

Figure 11:
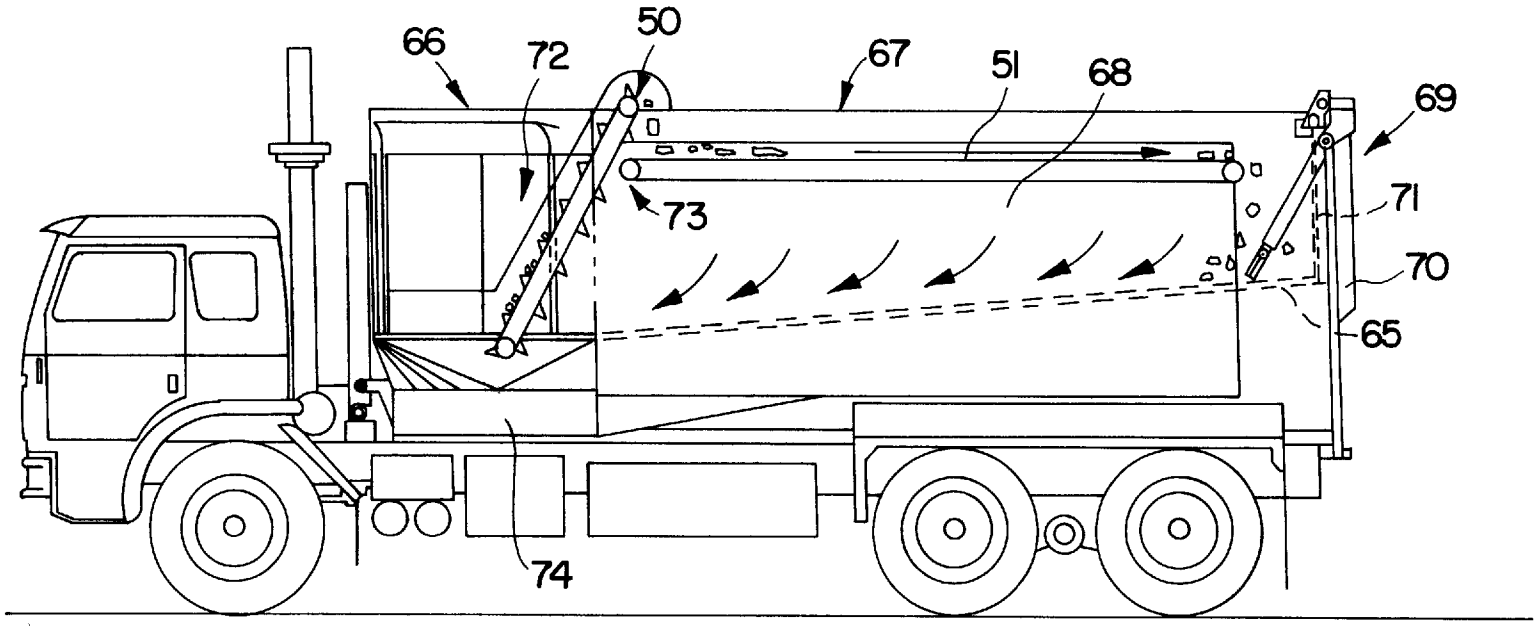
FIG. 11 is a part sectional side view illustrating another embodiment of a refuse vehicle according to the present invention having upper and lower tank sections.

Referring to FIG. 11, there is illustrated another vehicle according to the invention. In this case, the vehicle does not include the bubble door of the previous embodiments, but can do so.

The vehicle in this case has a partition 65 defining upper and lower storage regions which partition slopes toward a forward end 66 of tank section 67 so that material such as glass will vibrate forward in an upper storage region 68 and gradually fill from the rearward end 69 toward the forward end 66.

The embodiment of FIG. 11 includes two doors, an outer door 70 which extends the full length and width of the vehicle while a second door 71 to storage region 68 is located inside the door 70.

The vehicle includes an entrance 72 adjacent the forward end 66 of the tank section 67. The entrance communicates with respective upper and lower material transfer mechanisms which in this case comprises a conveyor assembly 73 and an oscillating compactor blade assembly shown generally at 74. This compactor blade assembly is the same as in the previous embodiments except the spill plate is omitted.

Figure 13:
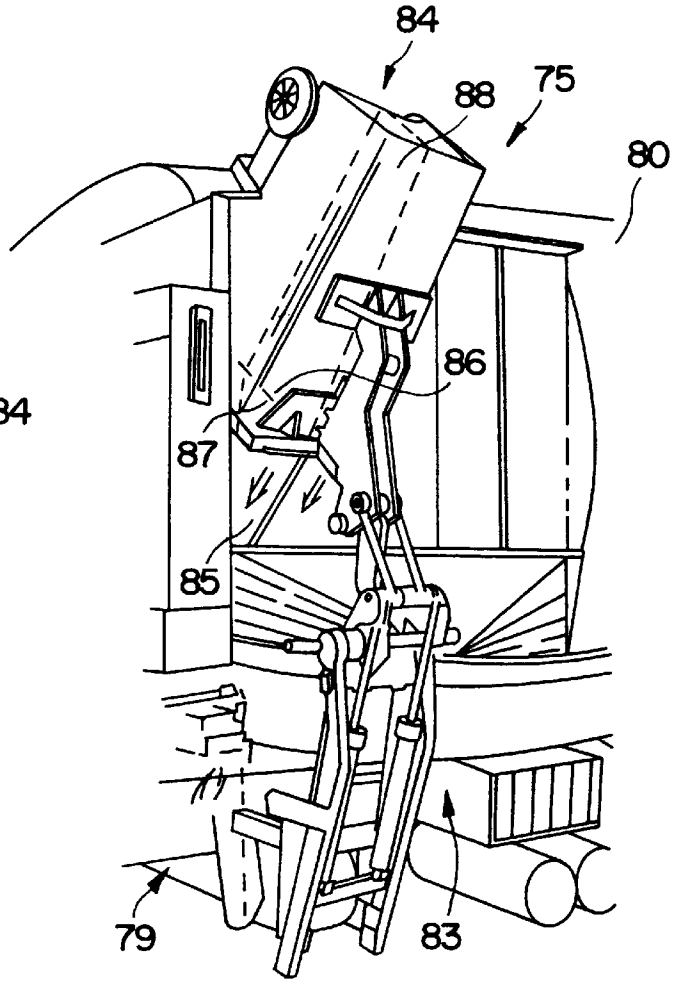
FIG. 13 is a part perspective view illustrating a further stage in the emptying process in relation to the refuse vehicle and bin of FIG. 12.
Figure 12:
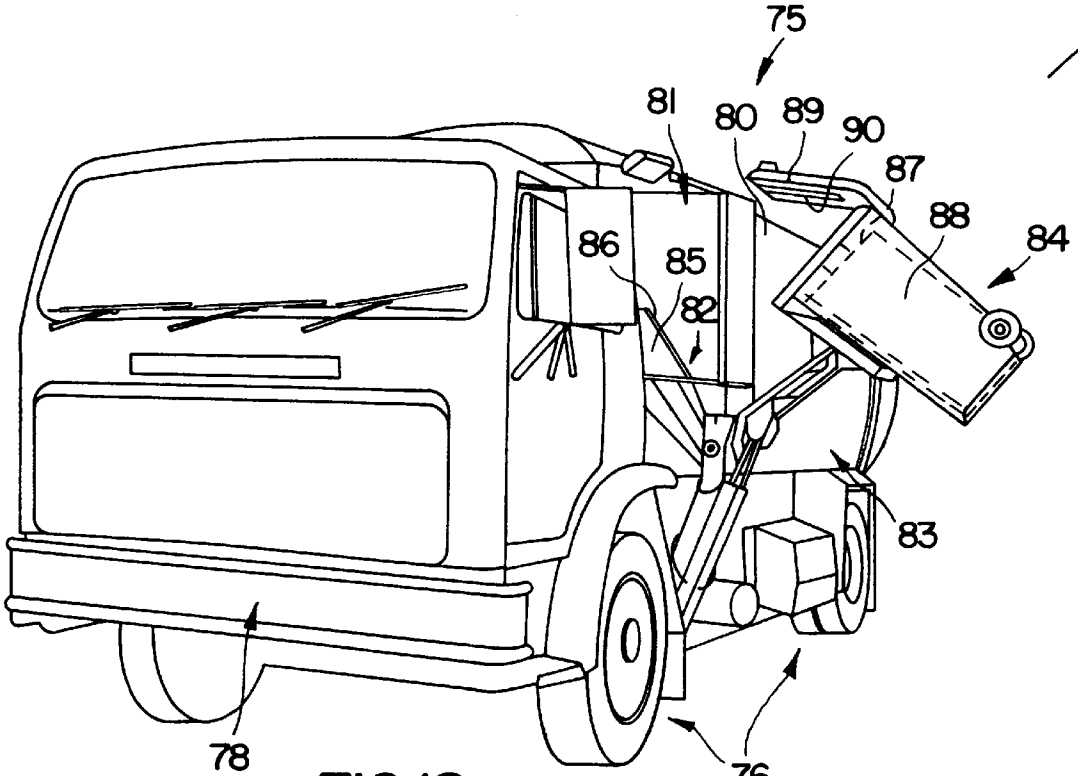
FIG. 12 is a pictorial view similar to that of FIG. 1 of another embodiment of a refuse vehicle according to the present invention showing a bin having side-by-side compartments being emptied.

Referring now to FIGS. 12 and 13, there is illustrated a refuse vehicle 75 for use with a multi-compartment bin having side-by-side compartments. In this case, the vehicle is a side loading refuse vehicle having a wheel assembly 76 supporting a cab 78 and a chassis 79. A storage tank 80 is mounted on the chassis, a hopper 81 communicates with the tank 80. The hopper has a loading aperture 82 adjacent a side of the vehicle 75 and a loading mechanism 83 is adjacent the hopper. The hopper is adapted to receive refuse from a bin 84 during a loading operation and a typical loading operation is illustrated in FIGS. 12 and 13.

As in the previous embodiments, the tank section 80 includes two tank sections. A refuse transfer mechanism is employed to move refuse delivered into the hopper into the tank 80 and in the illustrated embodiment includes a refuse separator means in the form of a divider plate 85, the leading edge 86 of which aligns and abuts against or is closely spaced from an upper edge 87 of a partition 88 in the bin 84. The partition 88 divides the bin 84 into two side-by-side compartments and as will be appreciated from the foregoing description, when the bin 84 is inverted over the hopper as illustrated in FIG. 13, the contents of the respective compartments are maintained separate by virtue of the divider plate 85 being in place.

As can be seen in FIG. 12, the bin 84 includes a lid 89 which is illustrated in the position shown in FIG. 12 so that a slot 90 in the lid can be seen in the drawing. This slot 90 enables the lid to straddle the divider plate 85 and therefore the divider plate 85 does not interfere with operation of the lid 89.

Figure 14:
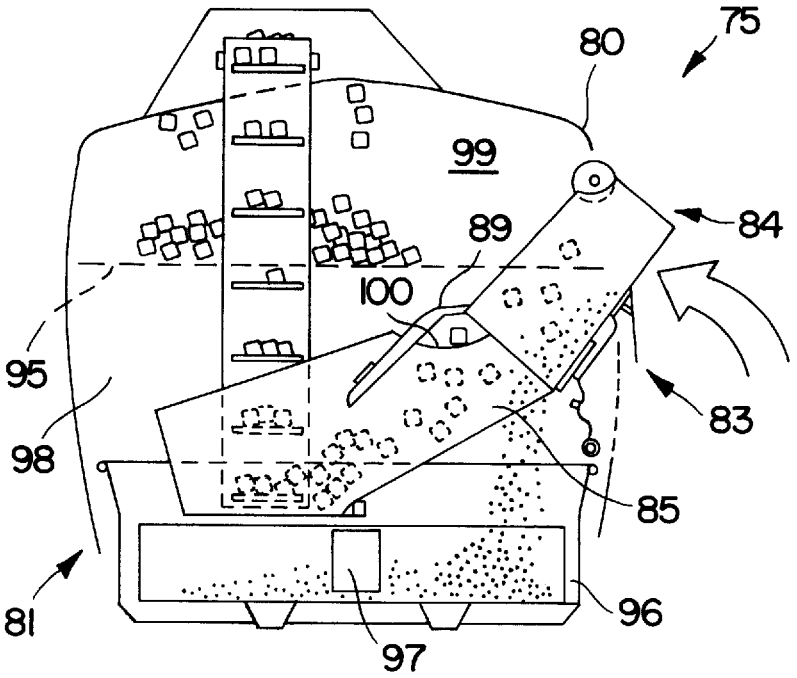
FIG. 14 is a vertical section through the refuse vehicle as noted in FIGS. 12 and 13 and illustrating a preferred transfer mechanism for that vehicle.
Figure 15:
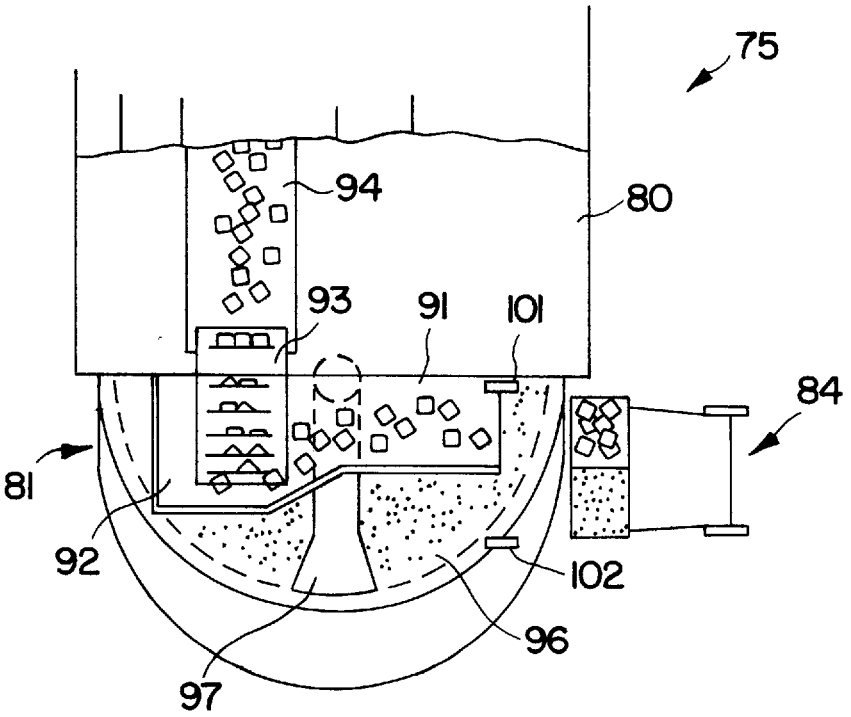
FIG. 15 is a part horizontal section through the refuse vehicle illustrated in FIGS. 12 and 13 and illustrating the transfer mechanism of FIG. 14.

Referring to FIGS. 14 and 15, there is illustrated in more detail internal operation and construction of the vehicle 75. Where appropriate, like numerals have been used to illustrate like features. As can be seen, the plate 85 defines a side wall of a chute 91 along which refuse delivered into the hopper flows to a sub-hopper 92 which feeds an elevator 93. The elevator in turn feeds a conveyor 94, the conveyor and elevator deliver refuse into the tank section atop a partition 95 while other refuse free falls into a lower hopper section 96 where an oscillating blade 97 sweeps refuse into a lower tank section 98 below the partition 95. The upper tank section 99 typically carries commingled recyclables in the form of plastic bottles and cans while the lower tank section 98 typically carries other domestic garbage.

As can be seen in FIG. 14, the lid 89 of the bin 84 swings freely by virtue of the slot 90 enabling passage of the divider plate 85. As a consequence of the slot 90 not extending the full width of the lid 89, the plate 85 includes a cut-out portion at 100 to accommodate for this feature.

As can be seen in FIG. 15, the bin 84 can be slightly out of position on the loading mechanism and for this reason, respective lead-in guides 101 and 102 are employed and these will be described in more detail in relation to FIGS. 16 and 17.

Figure 16:
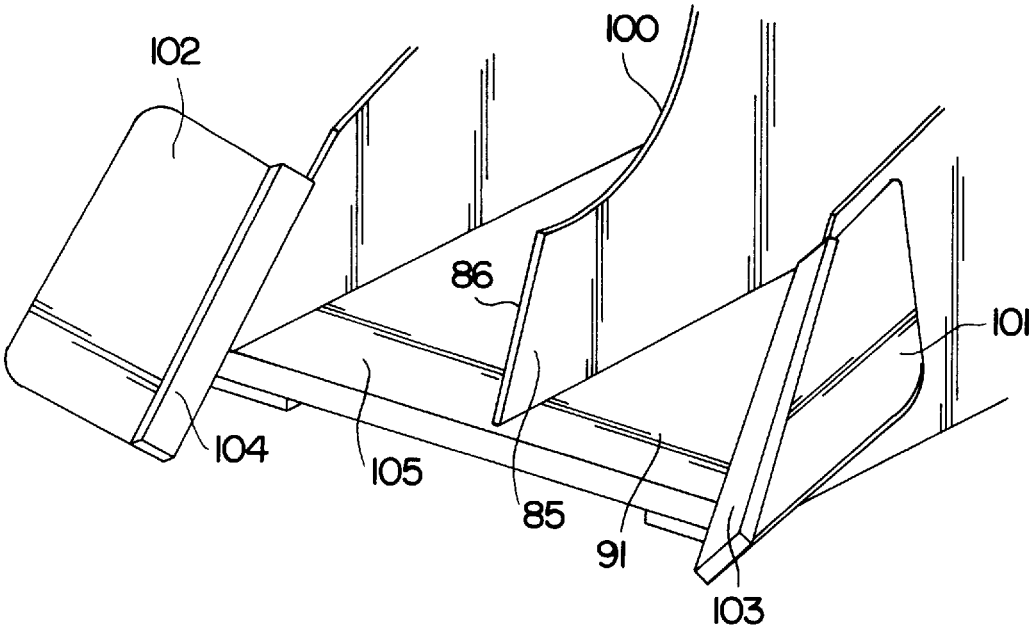
FIGS. 16 and 17 are pictorial views illustrating two different forms of refuse separator means according to preferred embodiments of the present invention and suitable for use with the vehicle of FIGS. 12 and 13.

Referring to FIG. 16, there is illustrated the basic configuration of the lead-in guides 101 and 102 relative to the divider plate 85 and the leading edge 86 thereof. As can be seen, the lead-in guides 101 and 102 comprise convergent plates which include bin abutment flange members 103 and 104. It will therefore be appreciated by virtue of the lead-in guides 101 and 102 and the position of the edge 86 that a bin loaded on to the flange members 103 and 104 will be suitably positioned so that the divider plate 85 serves its purpose for maintaining the refuse in the respective compartments of a bin separate as they are delivered into the hopper.

Figure 17:
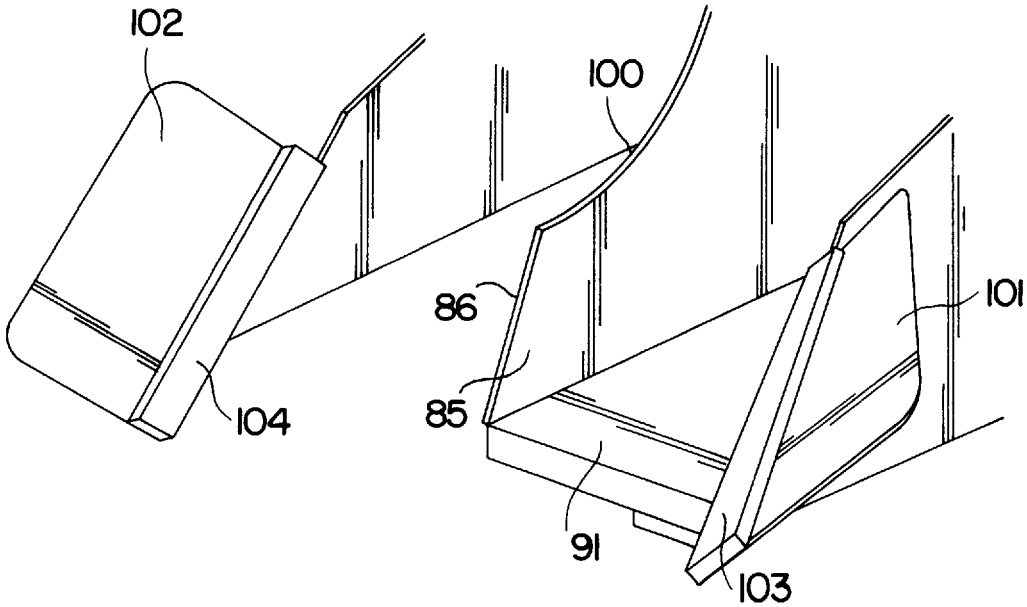

The embodiment of FIG. 17 is slightly different to that of FIG. 16 inasfar as this arrangement applies to a three tank section vehicle and to a three compartment bin having partitions defining a T-shaped upper edge similar to the bin 43 (see FIG. 7) and as can be seen in this case, a second ramp 105 is made available for refuse in the third compartment. In all other respects, the hopper is the same as for the previous embodiments.

Figure 18:
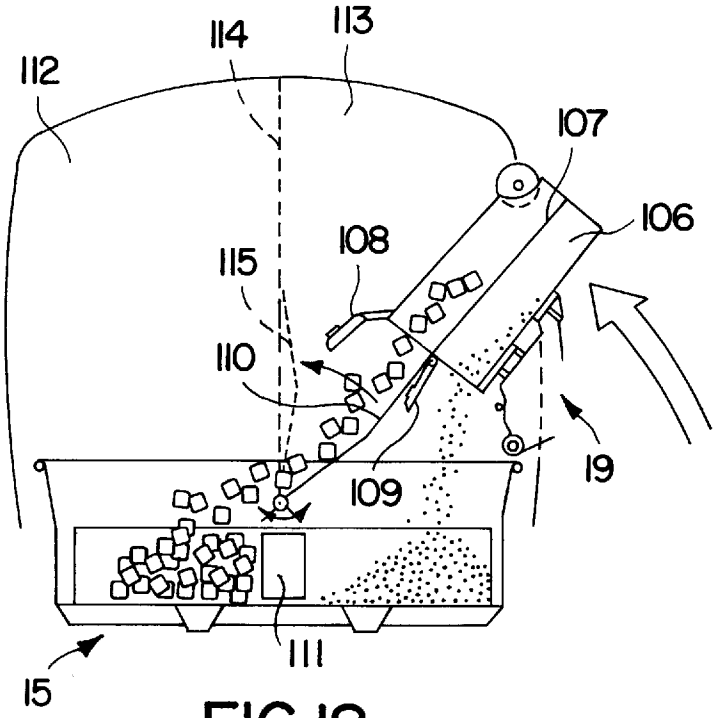
FIG. 18 is a vertical section through a hopper illustrating an alternative embodiment of the present invention involving a bin having two lids.

Referring now to FIG. 18, there is illustrated an alternative embodiment of a bin 106 where in this case a partition 107 extends as shown. In this case, the bin includes two lids 108 and 109 which swing open so the partition 107 engages with or becomes closely spaced from a moveable ramp 110. The contents of the bin flows to either side of an oscillating paddle 111 to be swept alternately into respective tank sections 112 and 113 defined either side of a vertical partition 114. The ramp 110 can be retracted to the position shown at 115 in the event of a contaminated bin being observed by the driver of the refuse vehicle so that all the contents of the bin can ultimately be delivered into the tank section 113.

Figure 19:
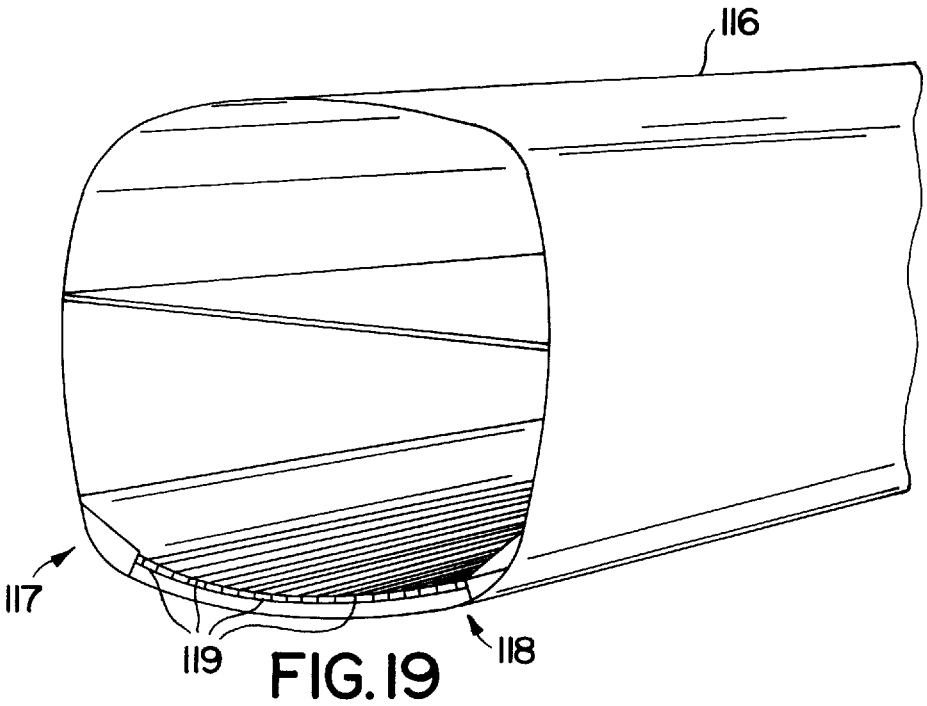
FIG. 19 is a pictorial view illustrating part of a tank section suitable for use in a vehicle according to the present invention involving a transfer mechanism having a travelling floor.

The previous embodiments have Illustrated the use of various transfer mechanisms including compacters and conveyors. Another form of conveyor that can be employed in a transfer mechanism is a travelling floor that can extend from say a sub-hopper right back or part way along one or more of the tank sections. Referring now to FIG. 19, a typical tank 116 is illustrated and as can be seen, the tank has a section which can be described as a medially bulged square shape which results in arcuate corner regions at 117 and 118. The travelling floor in this case includes a plurality of plates 119 arranged so the travelling floor is arcuate in shape to match the shape of the tank 116.

Figure 20:
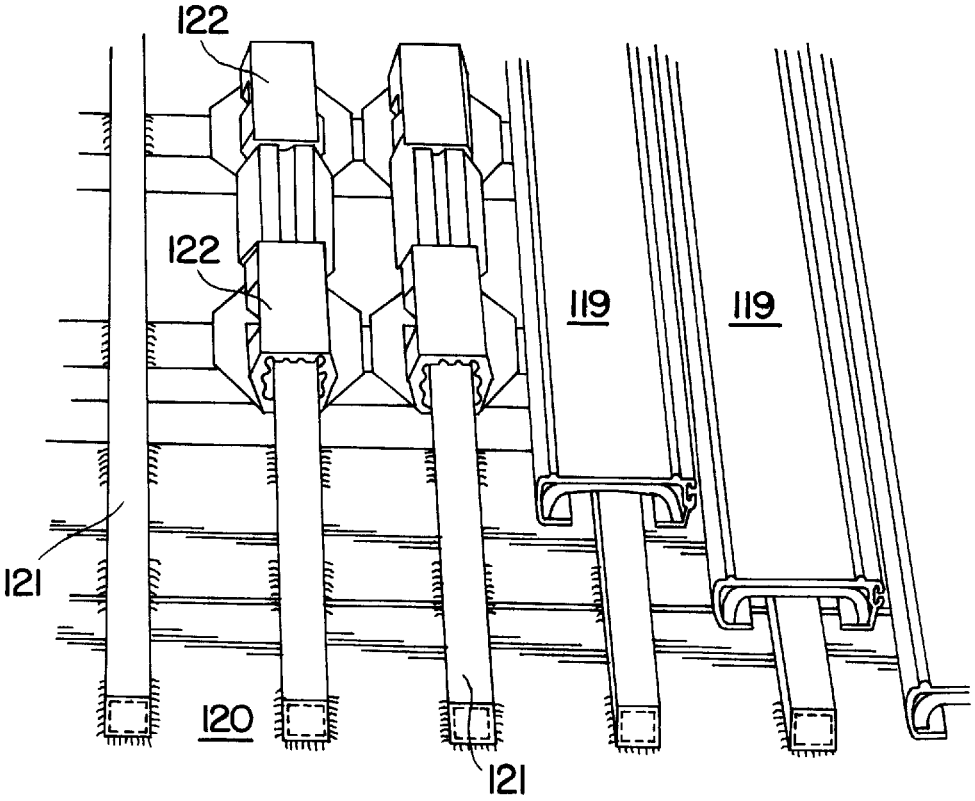
FIG. 20 is a view from above of a partially assembled travelling floor conveyor suitable for use in a vehicle according to the present invention.

Referring to FIG. 20, there is illustrated the form of the travelling floor which comprises a base 120 having a plurality of rails 121 on which are mounted self-lubricating plastics bearing members 122. The plates 119 are in the form of contiguous inverted channel members so that the plates 119 can reciprocate back and forth on the bearings 122 on the rails 121 in sealed relation.

Figure 21:
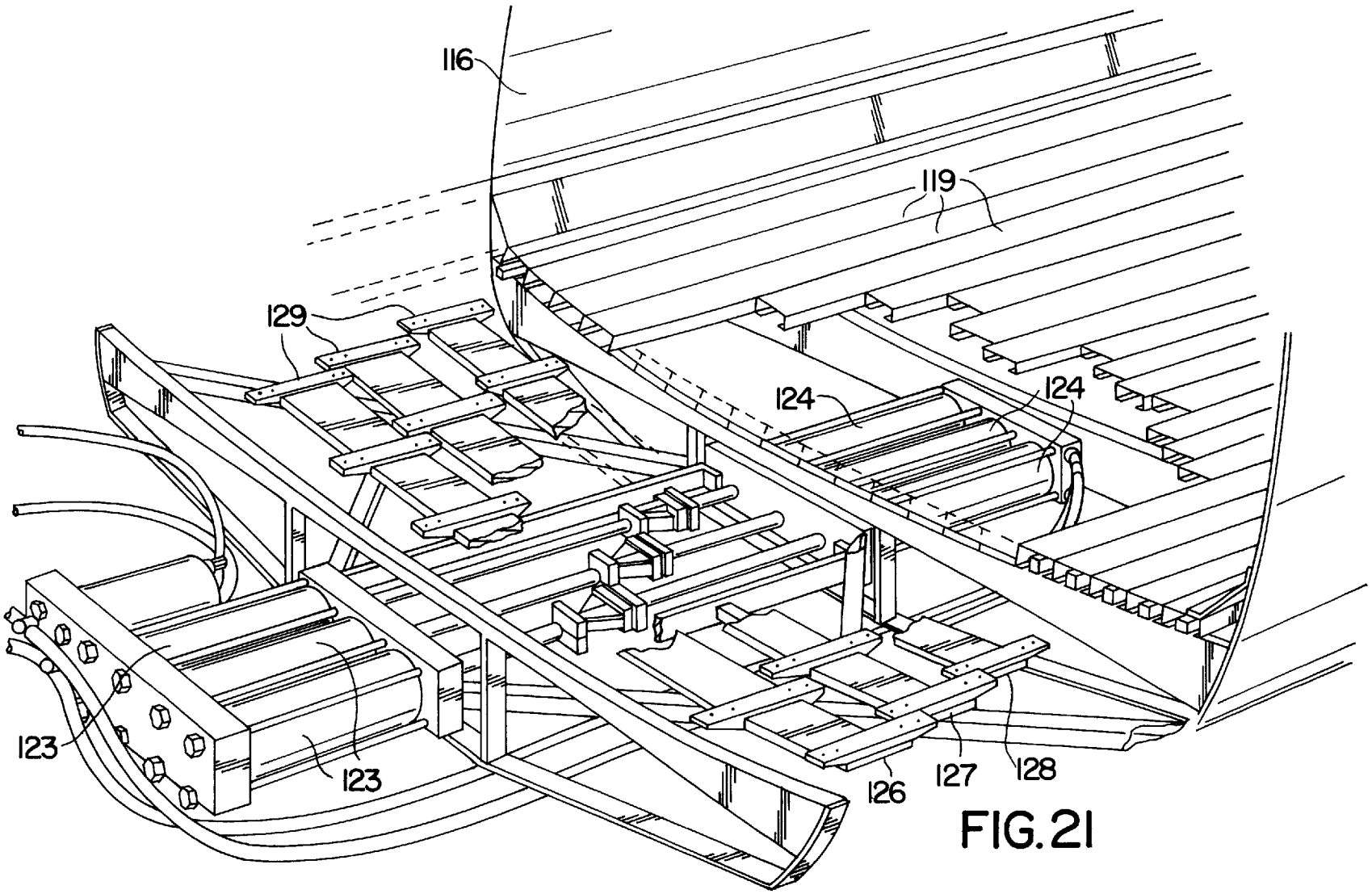
FIG. 21 is a detailed cut-away view illustrating operation of a travelling floor conveyor suitable for use in a vehicle according to the present invention.

Operation of a typical travelling floor is illustrated in FIG. 21 and where appropriate, like numerals have been used to illustrate like features. As can be seen, pairs of cylinder assemblies 123 and 124 are disposed at opposite ends of piston rods 125, each of which are connected to respective drive arms 126, 127 and 128. The drive arms 126, 127 and 128 are arcuate and have offset mounting bars 129 which are coupled to groups of the plates 119.

The resultant action upon controlled operation of the cylinder assemblies is that the plates 119 are all driven in unison in the discharge direction to move refuse into the tank section but are selectively retracted in the upstream direction so that the load being conveyed is not retracted with the individual plates 119. Usually every third plate 119 is retracted initially followed by every alternate remaining plate and then the final plates are retracted before all plates are driven on a downstream stroke once again to shift the load. Thus, the plates normally reciprocate over a range of about 12 inches as the cylinder assemblies 123 and 124 operate in predetermined sequence.

The travelling floor can be used in any tank section as the transfer mechanism or can be used in conjunction with any of the previous described transfer mechanisms.

Figure 22:
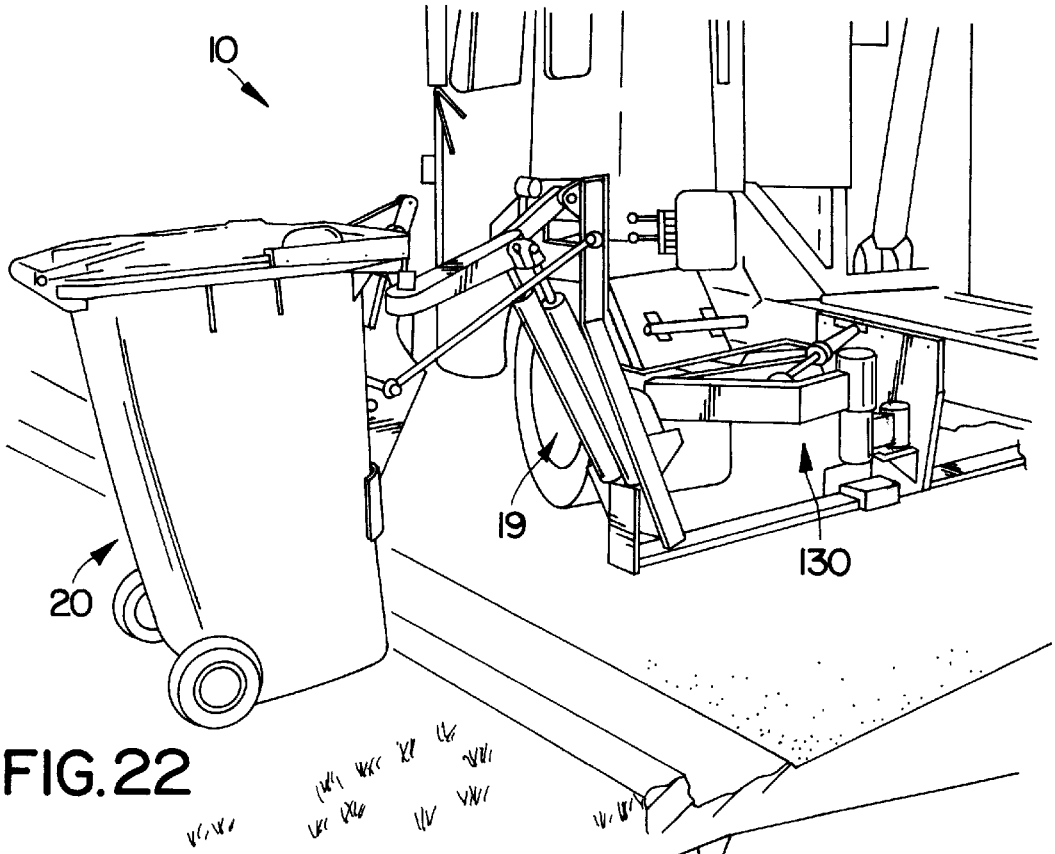
FIGS. 22 and 23 are pictorial views illustrating the present invention employing a loading mechanism suspended at the end of a retractable arm assembly.
Figure 23:
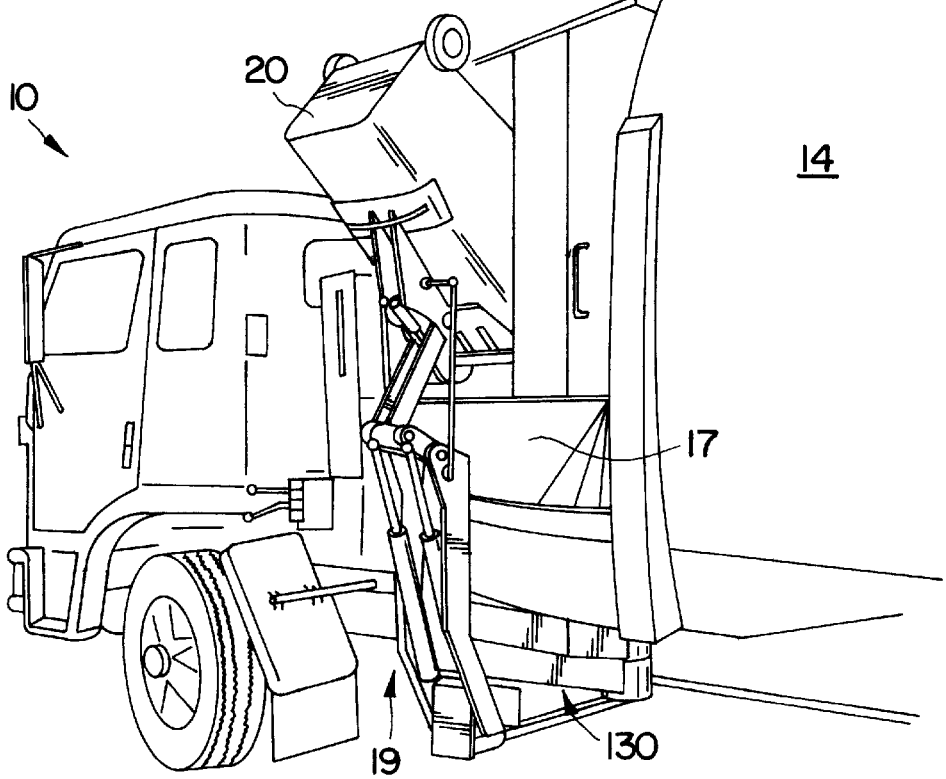

Referring now to FIGS. 22 and 23, there is illustrated a further embodiment, and where appropriate, like numerals have been used to illustrate like features. As can be seen, the only difference between the embodiments of FIGS. 3 and 4 and that of the earlier embodiments is that the loading mechanism 19 in this case is located at the end of a retractable arm assembly 130. The loading mechanism 19 can be extended transversely of the vehicle to engage a bin and then the loading mechanism 19 can be retracted to a position adjacent the hopper 17 wherein the bin can be tipped to the position illustrated in FIG. 23 so its contents can be discharged into the hopper 17. In this embodiment, operation of the loading mechanism, insofar as engaging a bin 20, is controlled from the vehicle cab 12 whereas in the embodiment of FIGS. 1 and 2, the loading mechanism 19 is fixed adjacent the hopper and the bin 20 must be placed in position by an operator. The retractable arm assembly or its mechanical equivalent can be used with any of the previous embodiments.

Whilst the above has been given by way of illustrative example of the present invention, many variations and modifications thereto will be apparent to those skilled in the art without departing from the broad ambit and scope of the invention as set forth in the appended claims.

I claim:

1. A side loading refuse vehicle having a forward end, opposed sides and a rearward end, comprising:

a driver's cab;

an elongated storage tank for storing refuse, the storage tank provided behind said driver's cab and having an upper storage region and a lower storage region, said upper storage region having a forward end and a rearward end, and said lower storage region having a forward end and a rearward end, said forward end of said lower storage region including a relatively narrow entrance leading into a relatively wide rear storage area;

receiving means for receiving refuse from a bin, including an entrance passageway provided behind said driver's cab and in front of said upper storage region and said lower storage region, said entrance passageway having separating means for separating the refuse into a first refuse stream and a second refuse stream;

loading means for loading the bin, said loading means including an arm located adjacent one of the opposed sides of the refuse vehicle and extendable sideways therefrom under control from said driver's cab, said loading means further including engaging means for engaging the bin and emptying refuse from the bin into said storage tank through said entrance passageway, wherein said arm is supported at a first end by the opposed side, and said engaging means is supported by another end of said arm;

a first refuse transfer mechanism provided downstream of said entrance passageway and including first moving means moving the first refuse stream into said upper storage region; and a second refuse transfer mechanism provided downstream of said entrance passageway and including second moving means, confined in its operation to said forward end of said lower storage region, receiving the second refuse stream and moving the second refuse stream to said lower storage region by pushing the second refuse stream through said narrow entrance, and compacting the second refuse stream within said rear storage area.

2. A side loading refuse vehicle according to claim 1, wherein said first moving means of said first refuse transfer mechanism comprises lateral moving means for moving recyclables including bottles longitudinally from said forward end of said upper storage region to said rearward end of said upper storage region with limited compaction of the recyclables in order to minimize breakage of the bottles.

3. A side loading refuse vehicle according to claim 1, wherein said second moving means of said second refuse transfer mechanism comprises compacting means for compacting non-recyclable refuse into said lower storage region.

4. A side loading refuse vehicle according to claim 1, wherein said upper storage region further comprises an upper wall and a floor, said floor sloping downwards from said rearward end towards said forward end of said upper storage region so that said floor causes compaction of refuse toward said forward end of said upper storage region when the vehicle is in motion.

5. A side loading refuse vehicle according to claim 1, wherein said first moving means of said first refuse transfer mechanism comprises an elevator to raise refuse from said entrance passageway up to said upper storage region.

6. A side loading refuse vehicle according to claim 1, wherein said separating means comprises a retractable chute moveable between a first position maintaining the first refuse stream and the second refuse stream separate, and a second position whereat refuse from the first refuse stream and the second refuse stream is movable to one of said upper storage region and said lower storage region.

7. A side loading refuse vehicle according to claim 1, wherein said elongated storage tank is divided by a longitudinally extending wall into two or more side-by-side storage regions, and said entrance passageway and said second moving means of said second refuse transfer mechanism include transport means for alternately transporting refuse into one of said side-by-side storage regions.

8. A side loading refuse vehicle according to claim 1, wherein:

said first moving means of said first refuse transfer mechanism comprises lateral moving means for moving recyclables including bottles longitudinally from said forward end of said upper storage region to said rearward end of said upper storage region; and said upper storage region further comprises an upper wall and a floor, said floor sloping downwards from said rearward end toward said forward end of said upper storage region, wherein said floor causes compaction of refuse toward said forward end of said upper storage region when the vehicle is in motion.

9. A side loading refuse vehicle according to claim 1, wherein:

said elongated storage tank is divided by a longitudinally extending wall into two or more side-by-side storage regions, at least one of the side-by-side storage regions having a forward end including a relatively narrow entrance leading into a relatively wide rear storage area; and said entrance passageway and said second moving means of said second transfer mechanism include transport means for alternately transporting and compacting refuse into one of said side-by-side storage regions.

10. A side loading refuse vehicle having a forward end, opposed sides and a rearward end, comprising:

a driver's cab;

an elongated storage tank for storing refuse, the storage tank provided behind said driver's cab and having an upper storage region and a lower storage region, said upper storage region having a forward end and a rearward end, and said lower storage region having a forward end and a rearward end, said forward end of said lower storage region including a relatively narrow entrance leading into a relatively wide rear storage area;

receiving means for receiving refuse from a bin, including an entrance passageway provided behind said driver's cab and in front of said upper storage region and said lower storage region, said entrance passageway having separating means for separating the refuse into a first refuse stream and a second refuse stream;

loading means for loading the bin, said loading means including an arm located adjacent one of the opposed sides of the refuse vehicle and extendable sideways therefrom under control from said driver's cab, said loading means further including engaging means for engaging the bin and emptying refuse from the bin into said storage tank through said entrance passageway, wherein said arm is supported at a first end by the opposed side, and said engaging means is supported by another end of said arm;

a first refuse transfer mechanism provided downstream of said entrance passageway and including first moving means moving the first refuse stream into said upper storage region; and a second refuse transfer mechanism provided downstream of said entrance passageway and including second moving means, confined in its operation to said forward end of said lower storage region, receiving the second refuse stream and moving the second refuse stream through said narrow entrance, and compacting the second refuse stream within said rearward end of said lower storage region, wherein said first moving means and said second moving means provide different levels of compaction of refuse in said upper storage region and said lower storage region, respectively.

11. A side loading refuse vehicle according to claim 10, wherein said upper storage region further comprises an upper wall and a floor, said floor sloping downwards from said rearward end towards said forward end of said upper storage region so that said floor causes compaction of refuse toward said forward end of said upper storage region when the vehicle is in motion.

12. A side loading refuse vehicle according to claim 10, wherein said separating means comprises a retractable chute moveable between a first position maintaining the first refuse stream and the second refuse stream separate, and a second position whereat refuse from the first refuse stream and the second refuse stream is movable to one of said upper storage region and said lower storage region.

13. A side loading refuse vehicle according to claim 10, wherein said elongated storage tank is divided by a longitudinally extending wall into two or more side-by-side storage regions, and said entrance passageway and said second moving means of said second refuse transfer mechanism include transport means for alternately transporting refuse into one of said side-by-side storage regions.

* * * * *